United States Patent [19]

Cough, Jr.

[11] 4,147,086

[45] Apr. 3, 1979

[54] GUITAR

[76] Inventor: Roy L. Cough, Jr., P.O. Box 704, Concord, N.H. 03301

[21] Appl. No.: 829,630

[22] Filed: Sep. 1, 1977

[51] Int. Cl.[2] ..... G10D 3/14

[52] U.S. Cl. ..... 84/312 P

[58] Field of Search ..... 84/312 P

[56] References Cited

U.S. PATENT DOCUMENTS

| | | | |
|---|---|---|---|
| 2,257,995 | 10/1941 | Abrams et al. | 84/312 P |
| 3,422,716 | 1/1969 | Alifano | 84/312 P |

*Primary Examiner*—L. T. Hix
*Assistant Examiner*—Benjamin R. Fuller
*Attorney, Agent, or Firm*—Schiller & Pandiscio

[57] ABSTRACT

A pedal steel guitar comprises an improved pitch changer mechanism for effecting string pitch changes. The mechanism comprises a plurality of pitch-changing fingers, each mounted for pivotal movement with respect to a selected axis and adapted to be connected to a guitar string end, so that tension on the string end will urge the finger in a selected direction, a stop for limiting movement of the fingers, a number of pitch bars each adapted to move relative to said axis and thereby mechanically force at least one of said fingers to move so as to change the pitch of the string attached thereto, and pull means for selectively moving the pitch bars so as to selectively change the pitch of the strings attached to said fingers. The changer mechanism may be adapted to raise or lower the pitch of each string.

28 Claims, 7 Drawing Figures

GUITAR

This invention relates to musical instruments and more particularly to pedal steel guitars, but is also applicable to Spanish guitars played with a slide, and banjos which the performers often retune on stage.

Steel guitars are so called after the fashion of performing upon them by stopping off the strings with a metal bar or slide. Pedal steel guitars are those in which the basic tuning of the instrument can be changed while playing upon it by means of changer mechanisms operated by foot pedals and/or knee levers. The changer mechanisms are adapted to change string pitch to the tone desired by increasing or decreasing the string tension. Typical changer mechanisms are capable of tightening or loosening individual strings separately or in concert to produce different tunings as desired by the operator. The usual pitch change mechanism is operated by pedals and/or knee levers acting through cables or rods commonly known as "pulls". Some systems, notably Emmons, use rods which effect changes both by pulling and pushing.

Existing pitch changer mechaisms are relatively complicated and expensive, particularly in the case where the guitar has a universal changer (any string pitch can be raised or lowered), double changer (any string can be raised or lowered two separate pitches ), and/or multiple changers (any string or group of strings can be raised or lowered to any pitch by any or all of the pedals). Other problems are excessive string wear due to unsatisfactory pitch changer design, a tendency for a changer to become "untuned" as a consequence of difficulty or criticality in adjustment of changer tuning or inexact changer operations, and excessive pedal or knee lever stroke to effect a desired pitch change. In addition to these difficulties, systems using rods connected to body-mounted bell cranks may cause the body to twist or distort and detune strings other than those desired to change. Accordingly the primary object of this invention is to provide a pitch changer mechanism for steel guitars which overcomes or substantially reduces the problems and limitations of prior known pitch changing devices.

A more specific object is to provide a simplified pitch changer mechanism which is capable of producing string-pitch changes in a simple and positive manner and may be adapted to raise or lower the pitch of a single string or several strings simultaneously by operation of a single player-operated actuator.

Another specific object is to produce a pitch change for steel guitars which is characterized by an economy of mechanism unapproached by any prior art device of comparable versatility of purpose and which improves the performance and durability of the instrument.

Another purpose is to provide a pitch changer for guitars which can be operated by either pedal or knee lever actuators, which may be made with the capability of changing one or several strings by one or more pitches; including the capability to raise and lower pitches simultaneously with one actuator.

Still another purpose is to provide a pitch changer where each pitch changer may be exactly adjusted by coaction of an adjustable pitch changing member with a positive stop.

A further object is to provide a steel guitar which constitutes an improvement in simplicity, cost and reliability over prior devices and can be made to provide significant advantages in performance.

These and other objects hereinafter described or made obvious are accomplished by providing a pitch changer mechanism comprising a plurality of pitch-changing fingers, each mounted for pivotal movement with respect to a selected axis and adapted to be connected to a guitar string end, so that tension on the string will urge the finger in a selected direction, a stop for limiting movement of the fingers, a number of pitch bars each adapted to move relative to said axis and thereby mechanically force at least one of said fingers to move so as to change the pitch of the string attached thereto, and pull means for selectively moving the pitch bars so as to selectively change the pitch of the strings attached to said fingers. The changer mechanism may be adapted to raise or lower the pitch of the string.

Other features and many of the attendant advantages of the invention are specified or made obvious by the following detailed descriptions of several embodiments of the invention and the accompanying drawings wherein.

Figure 1:
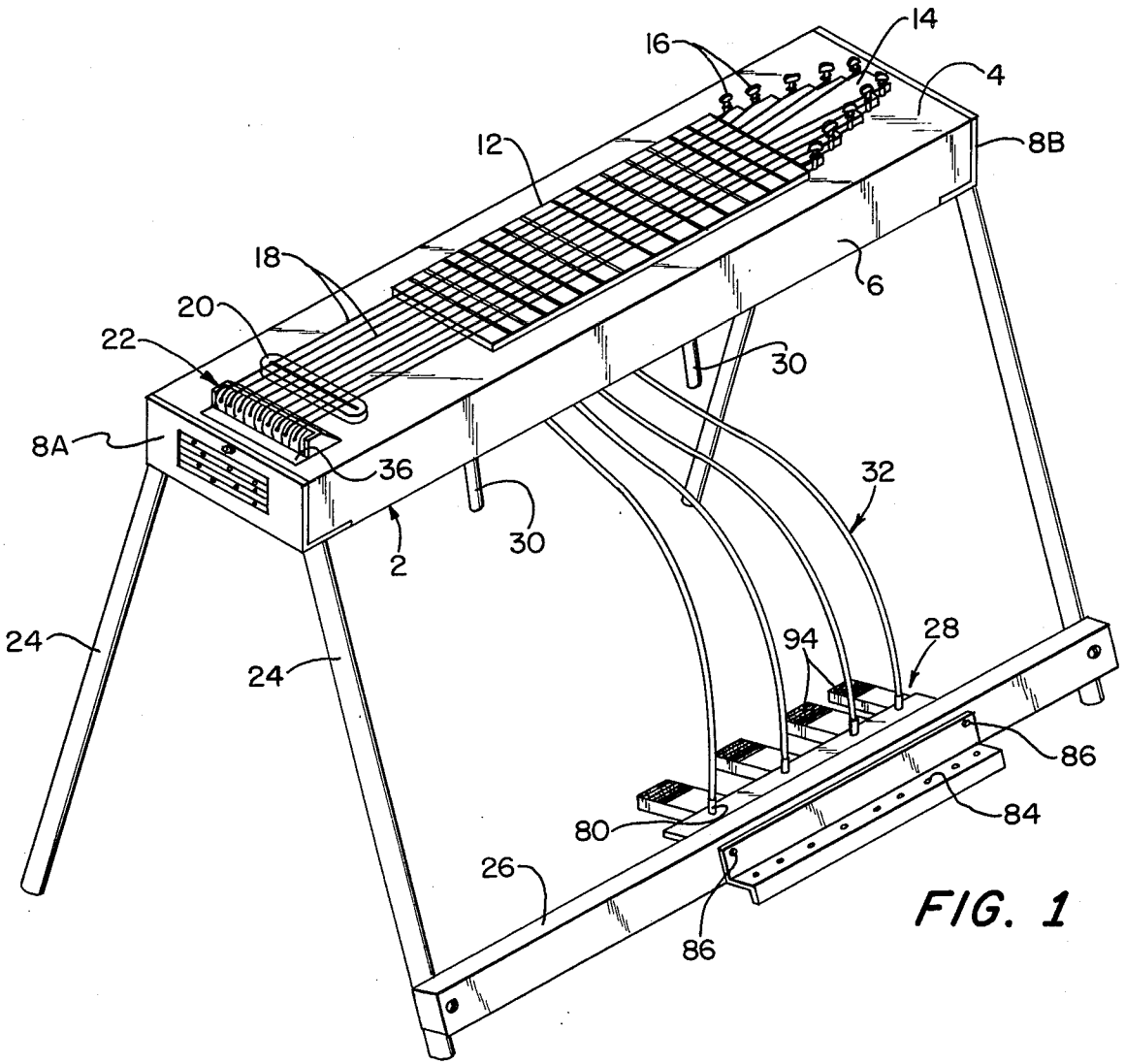
FIG. 1 is a perspective view of a pedal steel guitar embodying a pitch changer which constitutes a preferred form of the invention.

Referring to FIG. 1 there is shown a pedal steel guitar which comprises a cabinet or superstructure 2 consisting of an consisting of an upper panel 4, a front apron 6, a corresponding rear apron (not visible), and opposite end plates 8A and 8B. The top panel carries a fret board 12 and a tuning key head 14 provided with adjustable tuning keys or pegs 16. The metal guitar strings or wires 18 are attached at one end to the pegs 16 and pass over an electronic pickup 20 which is mounted on the top panel 4. Suitable means (not shown) are used to couple the pickup to an amplifier and speaker system (also not shown). To the extent already described the cabinet 2 and the structure which it supports are conventional and do not differ substantially from pedal steel guitars of the type which have been (commercially available for some time. The opposite ends of the strings are attached to a novel pitch changer head 22 which forms the essence of the present invention and is described in detail hereinafter.

The cabinet 2 is supported on four legs 24 at a suitable level above the floor. Extending across between the two front legs 24 is a cross member which may be made of any suitable material such as wood or metal. As described in greater detail hereinafter, cross member 26 supports a pedal mechanism identified generally by the numeral 28. This pedal mechanism forms part of the present invention and is described in greater detail hereinafter. The instrument also may include one or more knee levers 30. Although not shown, it is to be understood that knee levers 30 are mounted to the underside of the cabinet 2 in any suitable manner, preferably in the manner in which knee levers are commonly attached to the superstructure of conventional pedal steel guitars. Knee levers 30 and the pedal mechanism 28 are both lever means and are connected to the pitch changer head 22 by suitable means for effecting the pitch change of one or more of the strings 18 with the knee or foot. In the case of the pedal mechanism, the lever means is in the form of individual pedals, coupled to the pitch changer mechanism by sheathed cables 32, as hereinafter described. The knee levers may be connected to the pitch changer head by other sheathed cables (not shown) similar to cables 32, or by non-sheathed cables or pulls similar to the manner in which knee levers are conventionally coupled to pitch changer heads.

Figure 2:
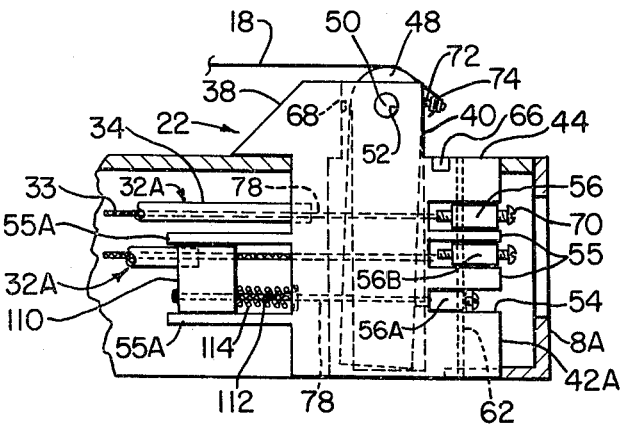
FIG. 2 is a left side elevation, partly in section, of the pitch changer of the instrument of FIG. 1.
Figure 3:
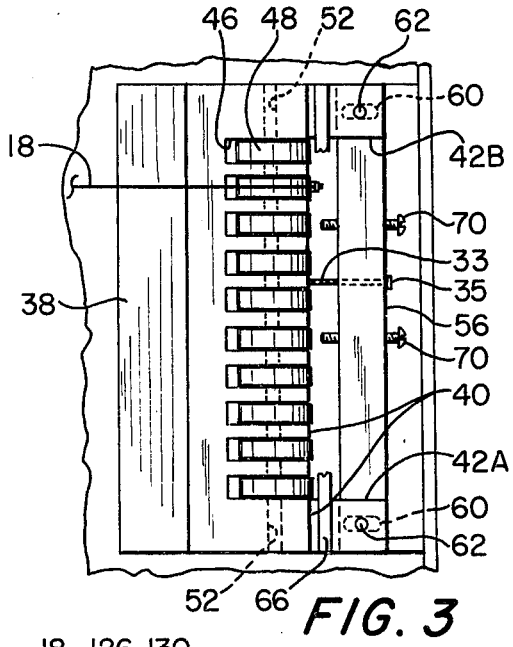
FIG. 3 is a plan view of the same pitch changer.

Referring now to FIGS. 1, 2 and 3, the upper panel 4 of the cabinet is provided with a suitable opening 36 (FIG. 1) to accommodate the upper end of the base block 38 of the pitch changer head 22. Base block 38 is secured to the upper panel and preferably also to the front and rear aprons 6 of the cabinet so as to prevent it from moving relative to the superstructure 2. Base block 38 has a rear vertical surface 40 extending between a pair of rearwardly extending arms 42A and B. The latter are cut away on top so as to form flat upper surfaces 44 that are flush with upper panel 4 and intersect rear surface 40. Base block 38 is formed with a plurality of vertically extending slots 46 which intersect rear surface 40. Slots 46 extend fully from the upper to the lower end of the block and are sized so as to accommodate and make a close sliding fit with individual pitch changer fingers 48. The upper ends of fingers 48 are provided with openings to accommodate an axle or pivot shaft 50 which pivotally supports the fingers. The opposite ends of axle 50 are secured in holes 52 formed in the opposite ends of block 38.

Each arm 42A and B has a plurality of horizontal slots 54 which extend at a right angle to the sots 46 and subdivide a portion of the arm into separator members 55. Each slot in arm 42A is aligned with the corresponding slot in arm 42B. Slots 54 may be deep enough to intersect the plane of vertical wall 40. Preferably, however, slots 54 terminate short of wall 40 as shown in FIG. 2. The slots 54 accommodate pitch bars 56. As shown, slots 46 and 54 are formed with flat opposing sides, and pich changer fingers 48 and pitch bars 56 are correspondingly provided with flat opposite surfaces, thereby assuring that the pitch changer fingers and pitch bars will slide easily and smoothly in their respective slots. Each pitch bar is formed at its opposite ends with elongate holes 60 (FIG. 3), each accommodating a retaining pin 62. The two pins extend through holes in separator members 55 and have their upper and lower ends anchored in the upper and lower sections of arms 42A and B. Retainer pins 62 function to limit reciprocal movement of pitch bars 56 toward and away from pitch changer fingers 48. By suitably dimensioning the elongate holes 60 and the diameters of retainer pins 62, it is possible to assure that both ends of each pitch bar will move evenly with one another toward and away from the pitch changer fingers, thereby avoiding possible binding of the pitch bars.

Still referring to FIGS. 2 and 3, the upper surface 44 of arms 42A and B are provided with a groove for accommodating a stop in the form of a cross member 66. Cross member 66 is immobilized with respect to the base block and is sized and located so as to limit pivotal movement of the pitch changer fingers 48 in a counter clockwise direction (as viewed in FIG. 2) about axle 50. Although cross member 66 is shown as spaced from fingers 48 when the latter are substantially vertical, in practice the cross member may be located so that it will be engaged by the pitch changer fingers when the latter are vertical or nearly so. Pivotal movement of the pitch changer fingers by the pitch bars in the opposite direction (i.e., clockwise as seen in FIG. 2) is limited by the extent to which the pitch bars can move in slots 54 toward the fingers. However, as an alternative or added precautionary measure to prevent excessive tensioning of the strings, the slots 46 may be formed so as to provide surfaces 68 which are located so as to be engaged by and thereby limit pivotal movement of the fingers by the pitch bars before the pitch bars have reached the limit of travel in slots 54 determined by pins 62 and holes 60.

Each pitch bar may be adapted to operate one or more pitch changer fingers. For this purpose each pitch bar is provided with one or more threaded holes to accommodate tuning set screws 70. Each set screw 70 is located in line with a selected pitch changer finger, as shown in FIG. 3.

The upper end of each pitch finger is provided with a peg or dowel 72 to accommodate the so-called, "ball end" of a guitar string whereby each string is anchored to a corresponding pitch finger. Each ball end consists of a ring 74 to which the end of a string is affixed, with the ring being large enough to be slipped over a peg 72. The upper ends of the pitch fingers are rounded as shown in FIGS. 2 and 3 so as to minimize bending stresses on the strings as the pitch fingers are pivoted to increase the tension on the strings.

As already indicated, the pitch fingers are operated by the pitch bars, and the latter in turn are operated by the pedals or knee levers operating through sheathed cables 32. For this purpose, the base block 38 has a plurality of horizontally-extending holes 78 to slidably accommodate the wire sections 33 of cables 32. Each hole 78 is at the vertical level of one of the pitch bars and extends through the vertical surface 40 between a pair of pitch changer fingers. Each wire 33 extends through a hole in one of the pitch bars and is anchored thereto as shown at 35 in FIG. 3. Each hole 78 also is counterbored to receive the sheath portion 34 of a cable 32. The sheath 34 is anchored in the counterbore in a suitable manner, e.g. by a force or friction fit or by soldering or brazing. The wires 33 of more than one cable 32 may be connected to the same pitch bar, so that each pitch bar may be connected to and be operable by a single cable or selectively operable by any one of two or more cables.

Figure 4:
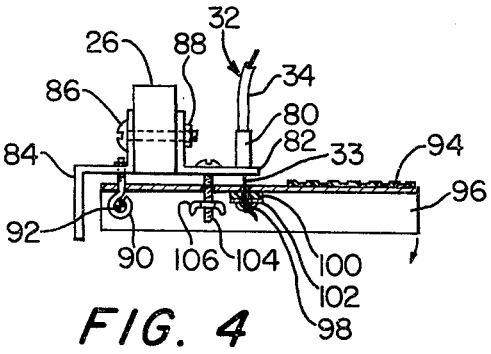
FIG. 4 is a fragmentary elevational view showing one of the pedal mechanisms for operating a "pull"

The opposite ends of the sheaths 34 of cables 32 may all be connected to the pedal mechanism 28, or one or more of them may be connected to one of the knee levers 30. In the case of the pedal mechanism, the opposite end of each cable sheath 34 is secured in a socket 80 (FIGS. 1 and 4) that is affixed to an angle iron 82 affixed to cross member 26. Angle iron 82 and a Z-bar 84 are secured to opposite sides of cross member 26 by suitable means such as screws 86 and nuts 88. The Z-member 84 is formed with a plurality of holes to accommodate two or more eye bolts 90 which are secured to the Z-bar in any suitable manner, such as by threaded nuts or cotter pins. The eye bolts support a pedal axle 92 which extends through the eye portion or hole of the eye bolts and also through the opposite side walls 96 of channel-shaped pedal members 94. Thus, each pedal member 94 is essentially a lever pivotally supported by axle 92. One or several pedals 94 may be mounted on axle 92 and suitable means such as tubular spacer sleeves, snap rings, cotter pins or the like (not shown) may be mounted on the axle for the purpose of preventing the axle from slipping out of its eyebolt supports and also for keeping the pedals mutually spaced so as to allow each pedal to be operable without interference from an adjacent pedal.

The wire 83 of each sheathed cable extends slidably through a hole in angle iron 82 and is attached to a pedal 94. This connection may be achieved by providing a hole in the upper section of the pedal through which the wire can be passed, and securing the free end of the wire to a soldered or brazed termination 98. Preferably, a rubber grommet 100 and a metal washer 102 are disposed between the upper portion of each pedal and the termination 98 for shock absorption. Pivotal movement of each of the pedals may be limited by suitable stop means. By way of example but not limitation, the stop means may comprise a screw 104 carried by the angle iron 82 and extending through an oversized hole in the upper portion of the pedal, with a suitable nut 106 secured to the screw and acting to prevent the screw from being withdrawn from the pedal. The position of the nut screw 104 may be adjusted to vary the extent to which the pedal can be forced down by the operator.

As is believed obvious from the foregoing disclosure, when a pedal 94 is depressed it will cause the wire 33 to slide longitudinally within the sheath 34 of a sheathed cable 32, whereby the pitch bar to which the wire cable is connected will be drawn toward the pitch changer fingers. The pitch bars do not directly engage the pitch changer fingers. Instead, when a pitch bar is drawn forward, the set screws 70 carried by that pitch bar will engage whatever fingers are located in the path of those set screws. In other words, each of the set screws is aligned with a particular finger and functions to actuate that finger when the pitch bar to which the set screw is mounted is drawn forward by operation of a pedal as previously described. The set screws can be moved in or out relative to the pitch bars to adjust the degree of pitch change. The amount by which the pitch changer fingers are pivoted is determined by the setting of screws 70. Thus, as the pitch bars are drawn towards the fingers, whatever finger is engaged by a set screw 70 will be pivoted clockwise (as seen in FIG. 2) and will thereby increase the tension on the string to which the finger is connected. Increasing the string tension has the effect of raising the string pitch. Thus, by appropriately positioning a set screw, it is possible for that set screw to move a finger far enough to effect one pitch change or more than one pitch change. Because of the tension on the strings, each pitch finger will move counterclockwise to its original position against stop member 66 when the pedals which placed it under increased tension is released.

FIG. 2 also shows how the same type of mechanism can be used to lower the pitch of a string. In this case, an auxiliary pitch bar 110 is provided. The ends of the auxiliary pitch bar are slidably mounted between and are supported by separator members 55A (which are extensions of base block 38) in a similar manner as previously described with respect to the pitch bars 56. Auxiliary pitch bar 110 is connected to one of the pitch bars 56A by means of a wire pull 112. Wire pull 112 is anchored at its ends to pitch bars 110 and 56A and is surrounded by a compression spring 114 which acts between base block 38 and pitch bar 110 to force the latter away from the former, whereby pitch bar 56A is drawn forward toward base block 38 and thereby "preloads" the strings whose pitch changer fingers are engaged by the set screws 70 carried by pitch bar 56A. One of the cables 32A has its wire 33 extend slidably through aligned holes in auxiliary pitch bar 110 and base block 38 and anchored in another pitch bar 56B, while the sheath of the same cable is anchored in a suitable counterbore in auxiliary pitch bar 110. Pitch bars 56A and B both have set screws 70. With this arrangement, the cable 32A is deliberately made long enough to provide slack, particularly where it is secured to the auxiliary pitch bar 110, so that depressing the pedal to which cable 32A is connected will cause a pull on that cable which will resolve itself by pulling on wire 33 (and hence pulling pitch bar 56B forward) and partly by simultaneously thrusting the sheath of cable 32A toward pitch bar 110 so as to cause the latter to compress spring 114. Thus the preload tension (determined by the set screw(s) of slide bar 56A) on the string(s) attached to the finger(s) engaged by the set screw(s) on pitch bar 56A is relaxed. Each such finger is allowed to rotate under the tension of the string to which it is attached to a new position dictated by a corresponding set screw 70 of the pitch bar 56B, whereby the pitch of the affected string or strings is lowered. It should be noted that the lowest pitch of the strings in question can be provided by allowing the finger(s) to contact the stop 66. Thus, any string can be lowered through more than one pitch change and still go to a positive stop (either by contacting the set screws 70 of pitch bar 56B or contacting stop 66) for each change. This point is made because many prior art mechanisms depend upon some sort of balance spring to hold the fingers at a mid-position; the present mechanism is different in that all stops may be solid and positive without depending on such prior art mechanisms.

Figure 5:
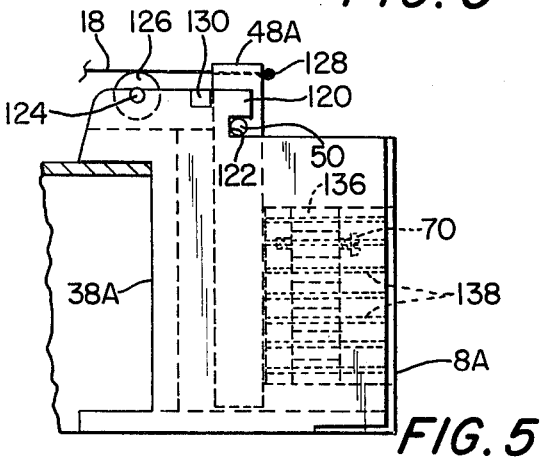
FIG. 5 is a left side view in elevation, partly in section, of a second form of pitch changer made in accordance with this invention.
Figure 6:
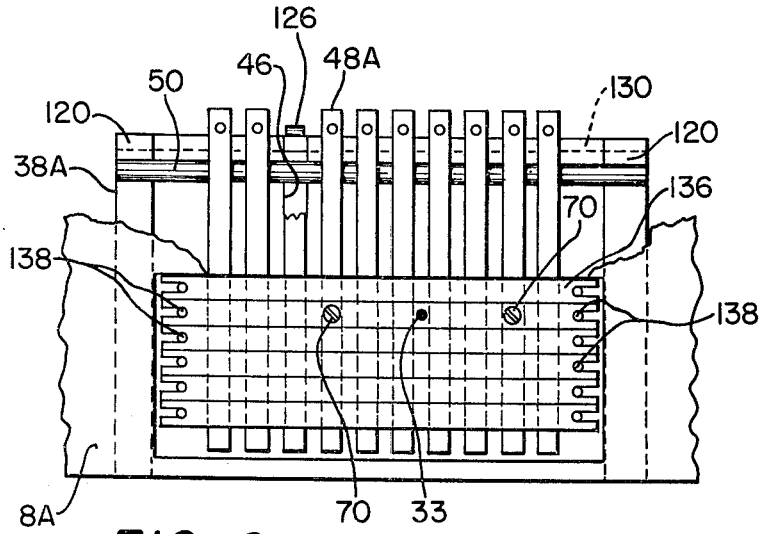
FIG. 6 is an end view in elevation of the changer shown in FIG. 5.

FIGS. 5 and 6 show another form of construction with two alternatively employable features. One feature involves providing notches 122 in upstanding mutually spaced side wall sections 120 of base block 38A to accommodate the pivot axle 50 of pitch changer fingers 48A and another axle 124 which supports a plurality of rollers 126, one for each string 18. Each roller 126 may, but need not, have a peripheral groove to accommodate a string 18, but preferably the peripheral surface of each roller 126 is flat from one side to the other. Roller 126 is located in advance of each finger 48A and each string 18 is threaded through an oversized hole in the upper end of the respective finger and is anchored thereto by an enlarged end termination 128 such as a ball end of the ring type previously described. A stop in the form of a bar 130 of rectangular or square cross-section extends between and is secured in side wall sections 120 directly in front of the fingers. Stop 130 limits counterclockwise rotation of fingers 48A and thus sets the at-rest position of those fingers. Each roller 126 may be located as shown so that the string which engages it is not bent by the roller when the corresponding finger is in its at-rest position. However, rollers 126 also may be raised slightly so that the portions of the strings running between the rollers and the fingers tend to be at an angle to the portion of the strings running from the rollers back to the fret board. By using rollers 126 it is possible to reduce costs, facilitate attachment of the strings to the fingers, and extend string life since the string is not bent over as severe a radius as in the embodiment of FIGS. 1-3.

A second alternative feature shown in FIGS. 5 and 6 is a different way of slidably supporting and spacing the pitch bars. In this case, each pitch bar 136 is formed with grooves at each end to slidably accommodate cantilever slide support rods 138 which are attached at one end to base block 38A. Rods 138 are rigid an thus each pair can act to effectively support a particular pitch bar in close but sliding relation to each adjacent pitch bar. If desired the ends of rods 138 remote from base block 38A also may be anchored, e.g. by locating them in close fitting holes in end plate 8A. As in the embodiments of FIGS. 1–4, each pitch bar has holes for accommodating the wires 33 of a cable 32 and tapped holes for set screws 70.

Figure 7:
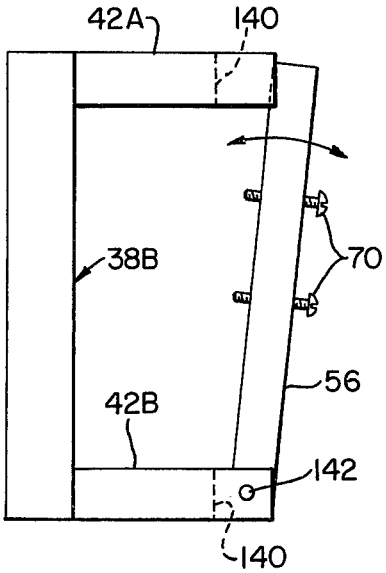
FIG. 7 is a plan view of still another form of the invention.

FIGS. 7 shows another modification. In this case the base block 38B has arms 42A and B which are slotted for a limited distance from their front ends (the ends of the slots are indicated at 140) to accommodate several pitch bars 56 which are pivotally secured at one end to arm 42B by a pivot pin 142. Although not shown, it is to be understood that the wires 33 of sheathed cables 32 are attached to pitch bars 56 and also to pedals 94 and/or knee levers 30 in the same manner as described in connection with FIGS. 1–4. With this arrangement, depressing a pedal 94 to exert a pull on a wire 33 will have the effect of causing a pitch bar 56 to pivot counterclockwise as seen in FIG. 7 to tighten the tension on one or more strings. The actual amount of pivotal travel of the pivotally mounted pitch bar may be relatively small for a single pitch change, e.g., 10–15° pivotal movement about pivot axis of the pin 142.

The guitar thus described has several advantages over prior art devices. Specifically, the pitch changer mechanism of the present invention is capable of producing string-pitch changes in a simple and positive manner and may be adapted to raise or lower the pitch of a single string or raise and lower several strings simultaneously by a single player-operated actuator. The use of set screws 70 and stops 66 and 130 provide positive stop action so as to provide more reliable string pitch changes Further, the pitch changer mechanism assures reliable tuning of the instrument and also provides an economy of mechanisms unapproached by any prior art device of comparable versatility of purpose and instrument durability. In this connection it should be noted that each pedal or knee lever may be connected to more than one cable 32, so as to permit more than one pitch bar 56 to be operated by a single action of the player. A very considerable advantage is provided by using sheathed cables 32 since they not only permit the use of a push-pull action as described heretofore of raising and lowering pitches, but which can be bent around to pull the fingers directly backward. These cables provide an advantage to the performer in that the assembly and disassembly of the instrument is greatly simplified. Instead of the necessity of removing a plurality of rods, the cables are simply wrapped around the pedal bar. Another advantage is that the stresses of the pitch changing mechanism are concentrated within the changer-pedal mechanism (or knee lever) complex and are not transferred to the guitar body, thereby avoiding stress-induced distortion of the guitar body.

Still another advantage is that the invention is susceptible of a number of modifications in addition to those already described. Thus, for example, tuning set screws 70 could be mounted to the pitch changer fingers 48 in position to be engaged by the pitch bars 56 when the latter are operated by cables 32. In this case, as in the embodiment of FIGS. 1–4, by screwing a set screw in or out it is possible to vary the amount a pitch changer finger is moved by a pitch bar and thereby to control the amount of resultant pitch change. It also is recognized that the cable system for operating the pitch changer mechanism makes the invention applicable to a guitar which is carried by a sling around the neck of the player who stands up in the manner of a "Dobro" player, in which case the pedal mechanism 28 may be mounted on a separate floor stand with the cables 32 running from the floor stand to the sling-supported instrument.

It is also recognized that the pitch changer mechanism may comprise two or more rows of pitch changer fingers 48, with separate cables being employed to operate pitch changer fingers in each row. It is also appreciated that the pitch changer mechanism may be modified by having a spring loaded pitch bar 56 coupled to a pitch changer finger 48 by a cable tether or a pivotal link of adjustable length, with the associated operating cable 32 having its cable member 33 attached to a stationary block and its sheath 34 anchored to the pitch bar, so that operation of the corresponding pedal will cause the aforesaid cable sheath to move the pitch bar in a direction to cause the coupled pitch changer finger to lower the pitch of a guitar string.

Since still other changes may be made in the above apparatus without departing from the scope of the invention herein involved, it is intended that all matter contained in the above description or shown in the accompanying drawings shall be interpreted in an illustrative and not in a limiting sense.

What is claimed is:

1. A guitar comprising a plurality of strings each having a first end and a second end, means for securing said first string ends to a fixed support, and end means for securing said second string ends to a fixed support, said end means comprising pitch changer means for adjusting the tension of at least two of said strings so as to vary the string pitch of said at least two strings, said pitch changer means comprising a base block; at least two fingers each having an upper end and a lower end, an axle pivotally securing the upper end of said fingers to said base block so that said fingers are spaced from one another, means securing said at least two strings to said at least two fingers so that the tension on said strings will vary according to the positions of said fingers, at least one elongate pitch bar mounted for movement relative to said base block toward and away from said fingers, adjustable means carried by said at least one pitch bar for directly applying a force to at least one of said fingers and moving said at least one finger in a direction to alter the string tension of any string which is secured on said finger when said at least one pitch bar is moved in a selected direction, a flexible cable attached to each of said at least one pitch bars having one end extending between said at least two fingers and attached to said pitch bar, and operating means for exerting a pull on said at least one cable so as to cause said cable to move said at least one pitch bar in said selected direction.

2. A guitar according to claim 1 wherein said operating means includes lever means and means mounting said lever means for movement by the player of the guitar, said lever means being connected to said at least one cable.

3. A guitar according to claim 1 wherein said pitch changer means comprises at least two separate pitch bars operatively associated with one of said fingers.

4. A guitar according to claim 1 wherein said end means further comprises at least three of said fingers, a plurality of said pitch bars each adapted to engage at least one of said fingers, plurality of cables each connected to each of said pitch bars, and lever means remotely located from said pitch bars and connected to each of said cables.

5. A guitar according to claim 1 wherein said at least one elongate pitch bar extends parallel to said finger axle.

6. A guitar according to claim 1 wherein said at least one pitch bar is pivotally mounted at one end.

7. A guitar according to claim 1 wherein said at least one pitch bar is mounted so that both ends thereof are slidable relative to said base block.

8. A guitar according to claim 1 comprising a plurality of said pitch bars each carried by said base block, with each of said strings being connected to a different one of said fingers.

9. A guitar according to claim 1 wherein said fixed support is a flat plate, and further wherein said at least two fingers are pivotally mounted to an axle which is fixed and extends parallel to said plate and said at least one pitch bar extends parallel to said plate, and further wherein said at least two fingers are provided with a pair of fixed stops to limit their travel about said axle.

10. A guitar according to claim 9 wherein said end means comprises a plurality of said pitch bars and a plurality of said fingers, with said fingers being disposed parallel to one another across the width of said plate, and said pitch bars being disposed one above the other parallel to said plate and on one side of said at least two fingers.

11. A guitar according to claim 1 wherein said at least two fingers are rounded at said upper end for accommodating said string and said means for securing said string to said finger includes a peg disposed on said finger.

12. A guitar according to claim 1 wherein at least one of said fingers includes a hole at said upper end thereof for accommodating a string which is secured on said finger, and roller means disposed in advance of said at least one finger so that said string which is secured on said finger contacts said roller when said finger is in a rest position.

13. A guitar according to claim 1 wherein said base block includes a slot for accommodating said axle.

14. A guitar according to claim 1 having a superstructure which serves as said fixed support, and further wherein the stresses of the pitch changer means are concentrated in said means and are not transferred to said superstructure.

15. A guitar comprising a plurality of strings each having a first end and a second end, a fixed support, first means securing said first string ends to said fixed support, and second means for securing said second string ends to said fixed support, said second end means comprising pitch changer means for adjusting the tension of at least one of said strings so as to vary the string pitch of said at least one string, said pitch changer means comprising a base block affixed to said fixed support, at least one finger having an upper end and a lower end and a front edge and a rear edge, an axle pivotally securing the upper end of said at least one finger to said base block, means securing at least one of said strings to said at least one finger so that the tension on said at least one string will vary according to the radial position of said finger, a first pitch bar assembly mounted in front of said front edge of said at least one finger for movement towards and away from said front edge, said first pitch bar assembly being adapted to engage said front edge and thereby move said at least one finger in a direction to increase the tension on said at least one string when said first pitch bar is moved in a first direction, a second pitch bar assembly mounted in front of the front edge of said at least one finger and adapted for movement parallel to said first pitch bar assembly, and a third pitch bar assembly mounted behind said rear edge of said finger and adapted for movement parallel to said first and second pitch bar assemblies, means for coupling said third pitch bar to said second pitch bar assembly, and means yieldably forcing said third pitch bar assembly away from said rear edge of said finger so that (1) said second pitch bar assembly will normally engage said front edge of said finger and thereby hold said finger from engaging said first pitch bar assembly, and (2) when said third pitch bar is suitably forced towards said rear edge of said finger, said second pitch bar assembly will move in a second opposite direction from said finger and said finger will move in a direction to decrease the tension on said at least one string, and operating means for causing said first and third pitch bar assemblies to move toward and away from said at least one finger.

16. A guitar according to claim 15 wherein said operating means includes sheathed cable attached to each of said first and third pitch bar assemblies.

17. A guitar according to claim 16 wherein said operating means includes lever means and means mounting said lever means for movement by the player of the guitar, said lever means being connected to at least one of said sheathed cables.

18. A guitar according to claim 15 comprising a plurality of fingers and a plurality of first pitch bars, with each of said strings connected to one of said fingers and each of said first pitch bars being adapted to move at least one of said fingers in a direction to alter the string tension of the string attached to said one finger when said first pitch bar is moved in a selected direction.

19. A guitar according to claim 15 wherein said first pitch bar assembly is pivotally mounted at one end.

20. A guitar according to claim 15 wherein said first pitch bar assembly is mounted so that both ends thereof are slidable relative to said base block.

21. A guitar according to claim 15 comprising a plurality of said fingers and a plurality of said pitch bars each carried by said base block, with each of said strings being connected to a different one of said fingers.

22. A guitar according to claim 15 wherein said fixed support is a flat plate, and further wherein said finger is pivotally mounted to an axle which is fixed and extends parallel to said plate and said pitch bars extend parallel to said plate.

23. A guitar according to claim 15 wherein said end means comprises a plurality of said first pitch bars and a plurality of said fingers, with said fingers being disposed parallel to one another across the width of said plate, and said pitch bars being disposed one above the other parallel to said plate.

24. A guitar according to claim 16 wherein one of said sheathed cables is disposed so that its sheath portion is attached to said third pitch bar assembly and its cable portion is attached to said second pitch bar assembly.

25. A guitar according to claim 15 wherein said finger has a hole at one end for accommodating one of said strings, and roller means disposed in advance of said finger so that said one string contacts said roller when said finger is in a rest position.

26. A guitar according to claim 15 wherein said base block includes a slot for accommodating said axle.

27. A guitar according to claim 15 having a superstructure which serves as said fixed support, and further wherein the stresses of the pitch changer means are concentrated therein and are not transferred to said superstructure.

28. A guitar comprising a plurality of strings each having a first end and a second end, means securing said first string ends to a fixed support, end means for securing said second string ends to a fixed support, said end means comprising pitch changer means for adjusting the tension of said strings so as to vary the string pitch of said strings, said pitch changer means comprising a base block, a plurality of fingers each having first and second opposite ends, a front edge and a rear edge, an axle pivotally securing the first ends of fingers to said base block, means securing each of said strings to one of said fingers so that the tension on said strings will vary according to the pivot position of said finger, a plurality of first pitch bars mounted on said base block in front of said front edges of said finger for movement towards and away from said front edges, said first pitch bars being adapted to selectively engage said front edges and thereby move said engaged fingers in a first direction when said pitch bars are urged against said front edges, a plurality of second pitch bars adapted for movement parallel to said first pitch bars toward and away from said fingers, and a plurality of third pitch bars mounted behind said rear edges of said fingers and adapted for movement parallel to said first and second pitch bars toward and away from said fingers, means coupling each of said third pitch bars to one of said second pitch bars, and spring means yieldably forcing said third pitch bars away from said rear edges of said fingers so that (1) said second pitch bars will normally engage said front edges of said fingers and thereby hold said fingers from engaging said first pitch bars, and (2) when said third pitch bars are forced towards said rear edge of said fingers, said second pitch bars will be disengaged from said fingers and said fingers will move in the direction of said first pitch bars, and operating means for selectively causing said first and third pitch bar assemblies to move toward and away from said fingers.

* * * * *

UNITED STATES PATENT AND TRADEMARK OFFICE

CERTIFICATE OF CORRECTION

PATENT NO. : 4147086
DATED : April 3, 1979
INVENTOR(S) : Roy L. Clough, Jr.

It is certified that error appears in the above-identified patent and that said Letters Patent are hereby corrected as shown below:

Claim 16, column 10, line 30, the word "a" should be inserted before the word "sheathed".

Paragraph [76] the inventor's name should be changed from "Roy L. Cough, Jr." to -- Roy L. Clough, Jr. --.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*